US011346634B2

(12) United States Patent
Sullivan

(10) Patent No.: US 11,346,634 B2
(45) Date of Patent: May 31, 2022

(54) TWO-STAGE AIRGUN FIRE AND RESET

(71) Applicant: Brian Sullivan, Alta Loma, CA (US)

(72) Inventor: Brian Sullivan, Alta Loma, CA (US)

(73) Assignee: Legacy Products LLC, McHenry, IL (US)

( * ) Notice: Subject to any disclaimer, the term of this patent is extended or adjusted under 35 U.S.C. 154(b) by 21 days.

(21) Appl. No.: 17/036,173

(22) Filed: Sep. 29, 2020

(65) Prior Publication Data

US 2022/0099404 A1 Mar. 31, 2022

(51) Int. Cl.
*F41B 11/00* (2013.01)
*F41B 11/721* (2013.01)
*F41B 11/62* (2013.01)

(52) U.S. Cl.
CPC ..... *F41B 11/721* (2013.01); *F41B 11/62* (2013.01)

(58) Field of Classification Search
CPC ..... F41A 21/10; F41A 11/02; F41A 21/484; F41B 11/62; F41B 11/52; F41B 11/55; F41B 11/721; F41B 11/54; F41B 11/722; F41B 11/723
USPC ..... 124/73, 41.1, 45, 49, 63, 71, 72, 74, 76, 124/82, 75, 77
See application file for complete search history.

(56) References Cited

U.S. PATENT DOCUMENTS 5,404,863 A * 4/1995 Poor ..... F41B 11/62 124/56
5,522,374 A * 6/1996 Clayton ..... F41B 11/54 124/48
5,771,875 A 6/1998 Sullivan
5,987,797 A 11/1999 Dustin
6,513,274 B1 2/2003 Vastag
6,637,420 B2 10/2003 Maritz
6,766,795 B1 * 7/2004 Sullivan ..... F41B 11/00 124/56
7,302,881 B1 12/2007 Tertin
7,562,478 B1 7/2009 Vastag
7,735,409 B1 6/2010 Tertin
7,926,408 B1 * 4/2011 Kley ..... F41G 1/02 89/41.17
8,761,702 B2 6/2014 Haub et al.
9,631,891 B2 * 4/2017 Sullivan ..... F41B 11/55
2006/0180134 A1 8/2006 Illuzzi
2007/0017497 A1 1/2007 Masse
2007/0089723 A1 4/2007 Mott
2010/0059032 A1 3/2010 Zadra
(Continued)

*Primary Examiner* — Michael D David
(74) *Attorney, Agent, or Firm* — Kirk A. Buhler; Buhler & Associates Patenting

(57) ABSTRACT

Improvements in a more efficient use of air in a projectile launcher is disclosed. The launcher uses a two-stage air gun fire and reset to have a more efficient compressed gas usage because the gas is not wasted by performing simultaneous actions, instead, the motion dedicates a portion of the motion to firing only then transitions a "port" to close and redirect the gasses to "re-cocking" without wasted gasses going out the firing bolt. The air is redirected through a moving port or gate to allow the launcher to continue to perform and "cycle" to the point where there is low pressure in the supply tank. This prevents chopping or shredding of paintballs because the feed port of the projectiles only partially opens. The improvement allows the launcher to reliably feed and fire projectiles down to the point where it is obvious that the tank requires changing.

20 Claims, 10 Drawing Sheets

(56) References Cited

U.S. PATENT DOCUMENTS

| | | | | |
|---|---|---|---|---|
| 2010/0282229 | A1 | 11/2010 | Tran | |
| 2015/0007804 | A1 | 1/2015 | Tippmann, Jr. et al. | |
| 2016/0047621 | A1 | 2/2016 | Sullivan | |
| 2019/0226795 | A1* | 7/2019 | Sullivan | F41B 11/55 |

* cited by examiner

TWO-STAGE AIRGUN FIRE AND RESET

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in pneumatic launchers and, more particularly, to novel systems and methods for pneumatically launching paintballs, pellets, metal BBs, airsoft BBs, or other projectiles.

Description of Related Art Including Information Disclosed Under 37 CFR 1.97 and 1.98

Conventional firearms have a firing mechanism to fire a projectile and a barrel to direct the projectile in a desired direction. Guns are made for numerous purposes and include many designs, for example, rifles, shot guns, and hand guns. A broad array of different mechanisms for firing a projectile have been employed for various types of guns. For example, one type of gun is dependent on having a propellant combined with the projectile. In this type of gun, the firing mechanism detonates the propellant contained in the projectile, which launches the projectile along the barrel. This type includes shot guns, which fire cartridges comprised of shot packaged with explosive material, and conventional rifles, machine guns, and handguns, which shoot bullets comprised of a unitary slug packaged with explosive material in a casing.

Another method of firing a projectile uses a propulsion source separate from the projectile, such as compressed gas, including air, carbon dioxide, nitrogen, and others. Examples of such guns include, air riffles, BB guns, and paintball guns or "markers." These guns either include a pump for compressing ambient air or are adapted to receive compressed air from a source, such as a compressed gas cartridge or gas cylinder. Conventional paintball guns rely on such cartridges or gas cylinders for supplying compressed gas, including air, nitrogen and carbon dioxide.

Nearly all similar "blowback" systems (simultaneously firing and re-cocking) begin an erratic and non-resetting motion to take place the moment that the system does not have enough supply gas pressure to completely "reset" the unit. "ALL" of these systems, because of that fact, begin to "chop and shred" paintballs because the feed port of the projectiles only partially opens. This non-resetting behavior occurs with most guns that are in the market around 650 psi at best (normal operating pressures and tanks for these systems is approximately 800 psi).

Another problem with pneumatic launcher is because the masses of the bolt or hammer is so large as opposed to the mass of the projectile and the surface area of the projectile. In the blowback system, in pressures below 650-800 psi the pressure is too low for the hammer to re-cock itself by sufficiently returning to engage on the sear. This problem is present in existing blowbacks launchers. Launchers that can operate at lower pressures have bad air use efficiencies.

What is needed is a two-stage air gun fire and reset or a flow directing closed bolt flow-back system that is more efficient use of compressed gas by not performing simultaneous actions of firing and reloading. The disclosure found in this document provides a solution.

BRIEF SUMMARY OF THE INVENTION

It is an object of the two-stage air gun fire and reset to have a more efficient compressed gas usage because the gas is not wasted by performing simultaneous actions, instead, the motion dedicates 1 portion of the motion to firing only then transitions a "port" to close and redirect the gasses to "re-cocking" (or reset only) without wasted gasses going out the firing bolt.

It is another object of the two-stage air gun fire and reset to redirect the gases through a moving port or a moving gate to allow the unit to continue to perform and "cycle" almost to the point where there is very little pressure in the supply tank or system. Nearly all similar "blowback" systems (simultaneously firing and re-cocking) begin an erratic and non-resetting motion to take place the moment that the system does not have enough supply gas pressure to completely "reset" the unit. "all" of these systems, because of that fact, begin to "chop and shred" paintballs because the feed port of the projectiles only partially opens.

It is still another object of the two-stage air gun fire and reset for the air gun to continue to cycle and reliably feed and fire projectiles down to the point where a user can visibly see and experience from a recoil that the projectiles are leaving the barrel at a speed that is slower than if a user was throwing the projectiles by hand that indicates that it is time to change the air tank.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
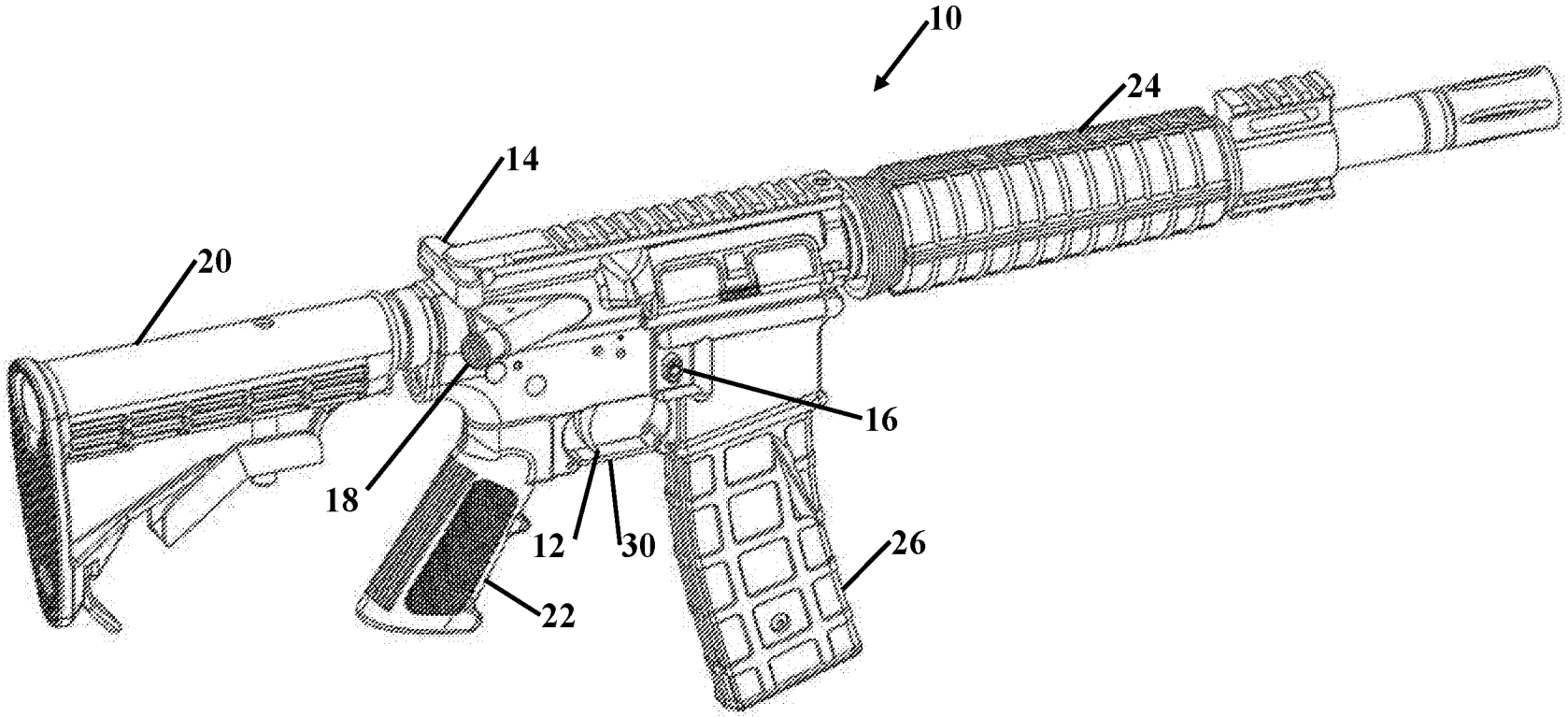
FIG. 1 shows a perspective view of the exterior of a launcher.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

| Item Numbers and Description | |
|---|---|
| 10 launcher | 12 trigger |
| 14 charger handle | 16 magazine release |
| 18 forward assist | 20 butt stock |
| 22 grip | 24 fore grip |
| 26 magazine | 30 trigger guard |
| 36 lower receive | 38 lower receiver |
| 40 valve assembly | 42 trigger assembly |
| 44 stock mount | 46 barrel |
| 48 barrel detent | 50 bolt assembly |
| 51 bolt assembly | 52 pins |
| 54 sear | 56 bolt catch |
| 57 catch | 58 pivots |
| 59 pivot | 60 biasing member |
| 61 cushion | 62 cushion |
| 63 stops | 64 front bolt |
| 65 rear bolt | 66 biasing member |
| 68 valve | 69 recock port |
| 70 conduits | 72 space |
| 74 ramp | 76 wear element |
| 78 manifold | 79 striker |
| 80 first aperture | 81 second aperture |
| 82 aperture | 84 particular space |
| 86 bolt sleeve | 87 bolt sleeve |
| 88 separator | 90 fastener(s) |
| 92 end cap | 94 buffer |
| 96 forward portion | 98 rearward position |
| 100 an extension | 102 slot |
| 104 aperture | 106 aperture |
| 108 aperture | 110 port |
| 112 projectile retainer | 114 projectile in breach |
| 120 first direction | 122 second direction |
| 124 gland area | 126 blown back |
| 130 bulkhead separator | 132 spring |
| 134 flange | 136 finite amount |
| 137 pin | 140 Port |
| 142 groove | 144 O-ring |
| 150 sliding bolt | 151 ball |
| 152 O-ring | 153 annular groove |
| 154 groove | 156 wire keeper |

-continued

| Item Numbers and Description | |
|---|---|
| 160 lug | 161 end |
| 162 slot | |

Referring to FIG. 1 a launcher 10 is shown in accordance with the one contemplated embodiment that may support pneumatic actuation of one or more components thereof. For example, a launcher 10 may support pneumatic actuation or manipulation of an action thereof. Alternatively, or in addition thereto, pneumatic forces may be responsible for propelling a projecting out of a launcher 10.

In selected embodiments, a launcher 10 may have an exterior look and feel that mimics, substantially matches, or matches the look and feel of a particular firearm (e.g., rifle, pistol, or the like). For example, as shown in FIG. 1, a launcher 10 may match or substantially match the exterior dimensions, look and feel, or the like of an AR-15 type rifle. A launcher 10 may also have external controls that match or substantially match the exterior controls of an AR-15 type rifle. Accordingly, a launcher 10 may provide an effective simulation or training platform.

For example, a launcher 10 may include a trigger 12, charging handle 14, magazine release 16, forward assist 18, butt stock 20 (e.g., adjustable butt stock), grip 22, fore grip 24, magazine 26, trigger guard 30, or the like or a combination or sub-combination thereof that collectively or individually match or substantially match the operations, sizes, shapes, and/or relative positions of comparable components on an AR-15 type rifle. In certain embodiments, all such components may be functional. In other embodiments, certain components (e.g., a forward assist 18 and/or bolt release) may be provided merely to maintain aesthetic realism but may otherwise be non-functional.

In certain embodiments, various components of a launcher 10 in accordance with the present invention may be actual AR-15 parts. For example, in selected embodiments, a butt stock 20, grip 22, fore grip 24, trigger guard 30, or the like or a combination or sub-combination thereof may be actual AR-15 parts (e.g., "milspec" parts, aftermarket parts, or the like). Accordingly, a user may customize his or her launcher 10 in the same manner and/or with the same parts as he or she would with an actual AR-15 type rifle.

Figure 2:
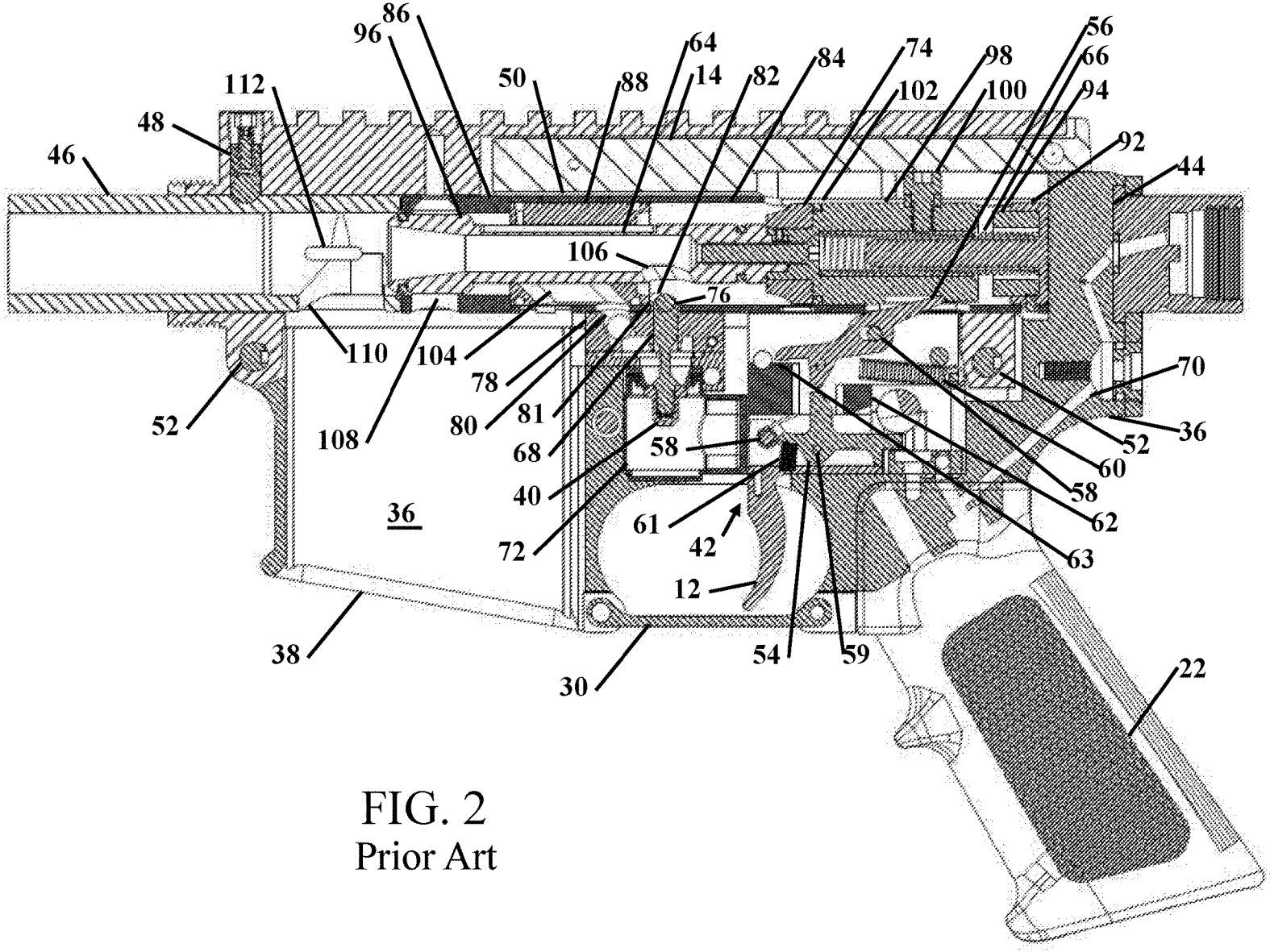
FIG. 2 Prior Art
FIG. 2 shows a sectional view of the launcher with the internal components.

Referring to FIG. 2, in selected embodiments, a launcher 10 may comprise an upper receiver (Not shown) and a lower receiver 38. For example, in certain embodiments, a magazine well, valve assembly 40, trigger assembly 42, grip 22, and stock mount 44 may correspond to a lower receiver 38, while a barrel 46, barrel detent 48, bolt assembly 50, and charging handle 14 may correspond to an upper receiver.

An upper receiver may be separable from a lower receiver 36. For example, one or more pins 52 may secure an upper receiver 34 to a lower receiver 36. Removal of one or more such pins 52 may grant access to a bolt assembly 50, valve assembly 40, trigger assembly 42, or the like. In selected embodiments, the various components of an upper receiver may be secured. Similarly, the various components of a lower receiver 36 may be secured. In selected embodiments, a trigger assembly 42 may include a trigger 12, sear 54, bolt catch 56, one or more pivots 58, 59, one or more biasing members 60, one or more cushions 61, 62, and one or more stops 63. Pulling the trigger 12 may cause a sear 54 to pivot until it contacts a bolt catch 56. With sufficient pressure, a sear 54 may urge a bolt catch 56 out of engagement with a bolt 64 of a bolt assembly 50. Once a bolt 64 is free of a bolt catch 56, the bolt 64 may move forward as biased by a biasing member 66 acting on the bolt 64. In selected embodiments, a bolt 64 may travel forward to actuate a valve 68 of a valve assembly 40.

Compressed gas (e.g., compressed air, compress carbon dioxide, or the like) may be conducted by one or more conduits 70 to an upstream side of a valve 68 in a suitable manner. In selected embodiments, a launcher 10 may provide or include a platform supporting multiple entry points for compressed gas. For example, in certain embodiments, a lower receiver 36 may include conduits 70 for receiving compressed gas from a butt stock (e.g., via a container or conduit located in the place of a "buffer tube") or a grip 22 (e.g., via a container or conduit located within a grip 22) or a combination thereof. In any given embodiment, entry points that are not to being used may be sealed with an appropriate plug. A manufacturer may have selected from among various arrangements or configurations with respect to the entry point of compressed gas.

Regardless of the entry point used, compressed gas may be passed by one or more conduits 70 from a reservoir, source, or container of some sort (e.g., 12 or 16-grain canister of carbon dioxide or the like) to an upstream side of a valve assembly 40 (e.g., past a trigger assembly 42 to a space 72 or cavity 72 on an upstream side of the valve assembly 40).

A valve 68 of a valve assembly 40 may be biased toward a closed position by the pressure of gas on the up-stream side of the valve 68, by a biasing member (e.g., by an unknown biasing member within the space 72 or cavity 72), or by some combination thereof. However, after a trigger 12 is pulled and a bolt 64 moves forward, a ramp 74 forming part of the bolt 64 may contact the top portion of the valve 68 (e.g., a wear element 76 of a valve 68) and force the valve 68 open.

In selected embodiments, a ramp 74 and/or wear element 76 of a valve 68 may be configured to provide a long service life. For example, materials used in the formation of a ramp 74 and/or wear element 76 may be selected to produce little wear on each other. In selected embodiments, one or both of a wear element 76 and a ramp 74 may be formed of a carbide material. Alternatively, or in addition thereto, a ramp 74 may be free to rotate with respect to other components of a bolt 64 (e.g., free to rotate about a central axis of a bolt 64). Accordingly, wear caused by the contact between a ramp 74 and a valve 68 may be distributed over a large area of the ramp 74.

With a valve 68 open, compressed gas may be able to pass from an upstream side of the valve 68 and through one or conduits of a manifold 78 forming a down-stream part of a valve assembly 40. Accordingly, in selected embodiments, a manifold 78 may control how compressed gas is distributed within a launcher 10. For example, in selected embodiments, a manifold 78 may include a first aperture 80 directing a first stream of compressed gas to launch a chambered projectile (not shown) and a second aperture 81 directing a second stream of compressed gas to an aperture 82 feeding a particular space 84 within a bolt assembly 50. Compressed gas within this particular space 84 may slow the forward motion of a bolt 64, stop the forward motion of the bolt 64, produce a rearward motion of the both 64, return a bolt 64 to a cocked position (e.g., where a bolt catch 56 has once again engaged a bolt 64), or some combination thereof.

In selected embodiments, a bolt assembly 50 may include a bolt sleeve 86, separator 88, end cap 92, buffer 94, bolt 64, or the like or a combination or sub-combination thereof. A bolt sleeve 86 may provide an interface between a bolt 64 and an upper receiver 34. In certain embodiments, a bolt sleeve 86 may include apertures permitting a valve 68, compressed gas, bolt catch 56, to enter a bolt assembly 50. A bolt sleeve 86 may have an interior surface against which various other components of a bolt assembly 50 may seal. In certain embodiments, a bolt sleeve 86 may be selectively removable. Accordingly, one or more fasteners 90 (e.g., threaded fasteners) may secure a bolt sleeve 86.

In selected embodiments, the separator 88 may separate compressed gas for launching a projectile from compressed gas for returning the bolt 64 to a cocked position. In selected embodiments, the bolt 64 may pass through a central aperture of a separator 88. Additionally, the separator 88 may include an aperture 104 aligned to receive compressed gas from a first aperture 80 of a manifold 78. Accordingly, once a valve 68 is actuated, this aperture 104 of the separator 88 may align with an aperture 106 in a forward portion 96 of the bolt 64, thereby enabling compressed gas to pass forward through a central (e.g., axial) aperture 108 in the forward portion 96 and propel a projectile out the barrel 46.

The end cap 92 may fit within a bolt sleeve 86 and provide an interface between a bolt assembly 50 and a stock mount 44 of a lower receiver 36. A stock mount 44 may be sized, shaped, and contain sufficient material (e.g., be substantially solid material as opposed to the ring of material found in an actual AR15 type rifle) to properly and repeatedly resolve the loads imposed thereon by a bolt assembly 50. In selected embodiments, the end cap 92 may include a center extension for supporting and aligning a biasing member 66 acting on the bolt 64. Alternatively, or in addition thereto, the end cap 92 may house, support, or locate the buffer 94. The buffer 94 may cushion an impact between a returning bolt 64 and the end cap 92.

The bolt 64 may include a forward portion 96, rearward portion 98, ramp 74, extension 100, or the like or a combination or sub-combination thereof. A rearward portion 98 may interface with the biasing member 66 urging the bolt 64 forward. For example, in selected embodiments, a rearward portion 98 may include an aperture for receiving such the biasing member 66. As a bolt moves forward, the forward portion 96 may push a projectile off the top of the magazine 26 and into the chamber location of the barrel 46. In a forward position, a forward portion 96 may also form a bridge for conducting compressed gas past one or more openings (e.g., a port 110 in a barrel through which projectiles pass) that would otherwise permit compressed gas to escape.

In selected embodiments, an extension 100 of the bolt 64 may extend through a corresponding slot 102 in the bolt sleeve 86. According, as the charging handle 14 is pulled rearward, it may engage an extension 100 and pull the bolt 64 rearward. This rearward motion may continue until the bolt catch 56 engages an appropriate edge, lip, or surface of the bolt 64 (e.g., of the rearward portion 98). In this manner, certain embodiments of the launcher 10 may be manually cocked.

The bolt assembly 50 may include various seals as desired or necessary. For example, one or more seals may interface between the forward portion 96 and the barrel 46, the separator 88 and the bolt sleeve 86 (grooves for seals are show in separator 88, by the seals are not shown), the separator and the forward portion 96, the rearward portion and a bolt sleeve 86, or the like or a combination or sub-combination thereof.

In selected embodiments, the barrel 46 may include a projectile retainer 112. The projectile retainer 112 may hold a projectile in a desired location, ready to be pushed forward into the chamber of the barrel 46. In certain embodiments, the projectile retainer 112 may deflect or pivot out of the way as the forward portion 96 of the bolt 64 chambers a projectile.

A launcher 10 in accordance with the present invention may be modular and easily converted between various configurations. For example, in selected embodiments, upper and lower receivers 36 may form a platform into which various modules or sub-assemblies may be easily swapped in and out. This swapping in and out may be accomplished with simple motions like threading fasteners and pushing or pulling pins and without any machining, welding, bonding, or other permanent changes.

For example, in selected embodiments, a lower receiver 36 and the components corresponding thereto may be left unchanged, while a barrel 46 and all or some portion of a bolt assembly 50 is replaced in an upper receiver.

In selected embodiments, the valve assembly 40 or some portion thereof (e.g., the manifold 78 may extend forward into a portion of the magazine well 38. This may enable the valve assembly 40 to receive compressed gas from the magazine 26. Alternatively, this may enable a valve assembly 40 to direct compressed air into a magazine 26. This compressed gas may then be used within the magazine to aid in some function such as urging projectiles or the like. In selected embodiments, compressed gas delivered to the magazine 26 may be stored in the form of advancing a piston or the like against a biasing member. In this manner energy from the compressed gas associated with multiple firing events may be collected and used as desired.

Figure 3:
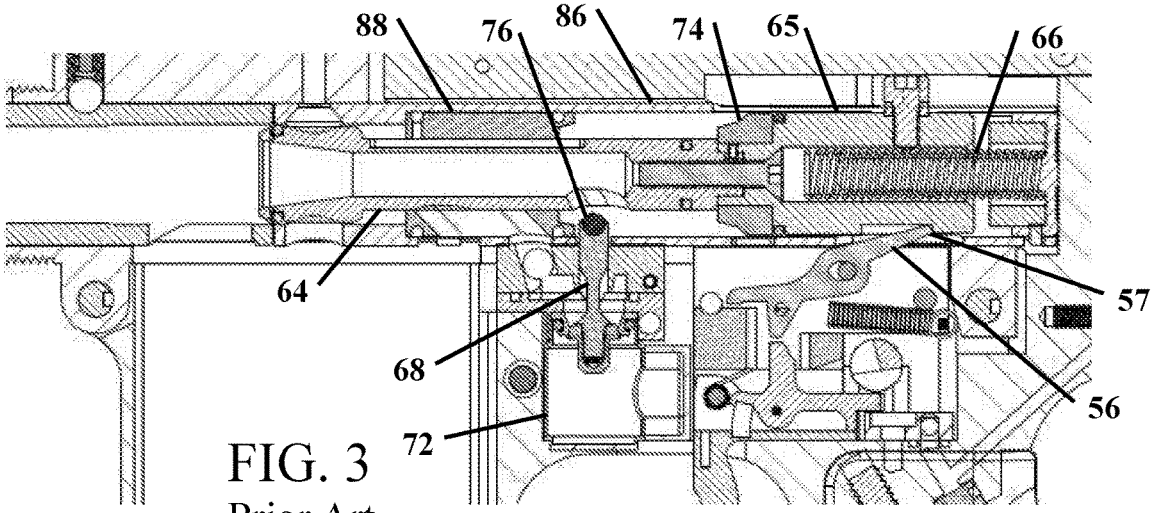
FIG. 3 Prior Art
FIG. 3 show a sectional view of a launcher in the cocked configuration.
Figure 4:
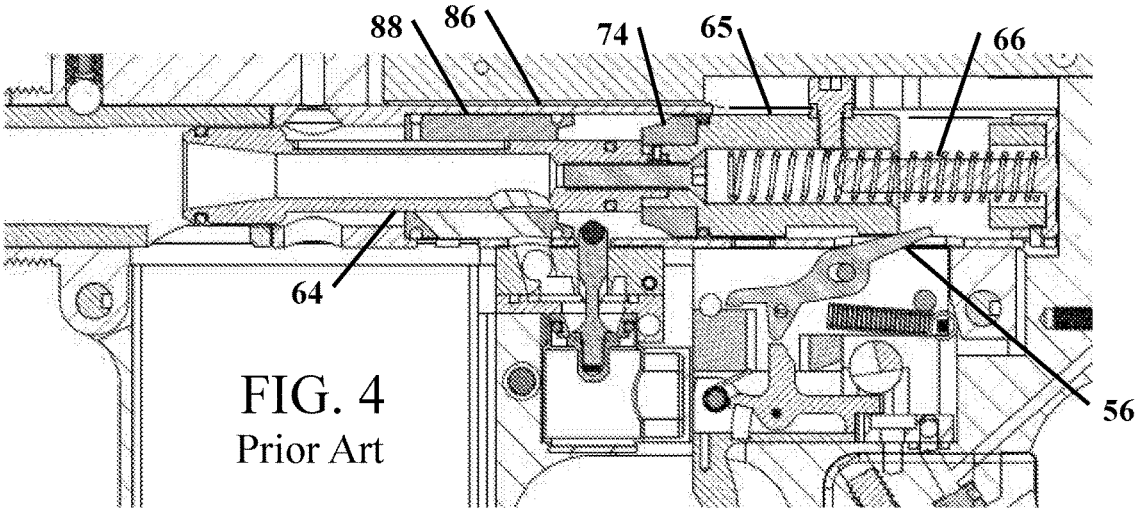
FIG. 4 Prior Art
FIG. 4 show a sectional view of a launcher in the mid launch.
Figure 5:
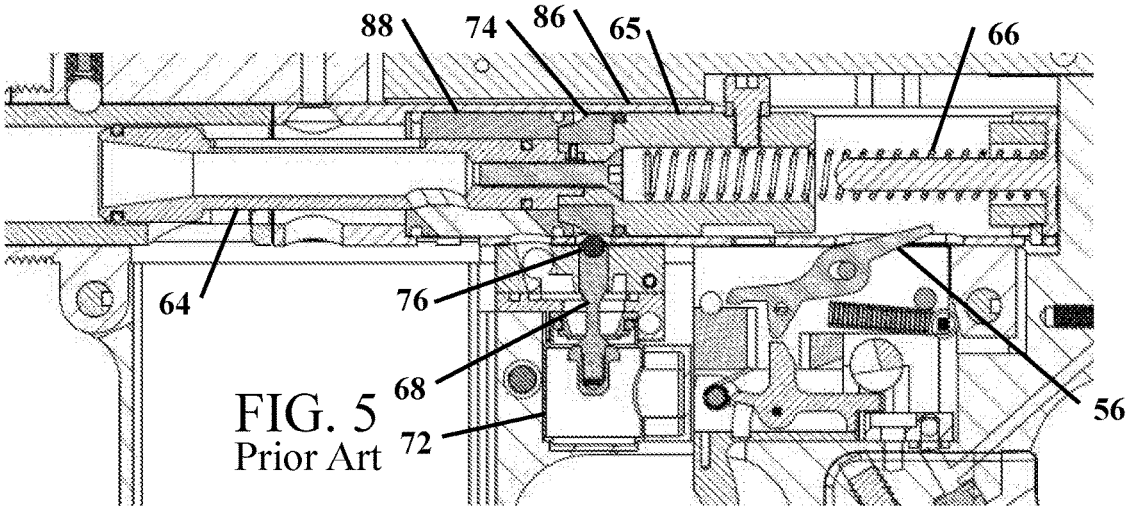
FIG. 5 Prior Art
FIG. 5 show a sectional view of a launcher with the bolt in a forward position.

When the motion of the bolt going forward, as a ball is loaded the striker goes forward and contacts the valve. The first thing the air wants to do is to immediately blow it back because the gasses are simultaneously going out to the ball and also back to the re-cock chamber. In the blow-back systems the air that is expelled is expelled against a very large diameter that translates into a very large surface area. This creates and additional piston that wants to be blown-back. Air is trying to blow the projectile out, while the pressure that is building to fire the projectile out is also trying to urge the chamber rearward against the valve. The following prior art description provides further description of the problem. FIG. 3 shows the prior art blowback bolt motion in the cocked rearward position, FIG. 4 shows the bolt assembly mid stroke, FIG. 5 shows the bolt assembly in the forward position. The separator 88 stays stationary in all the figures. The bolt assembly is the forward bolt 64, the ramp 74 and the rear bolt 65. In cocked configuration shown in FIG. 3, the bolt assembly is held in position in the bolt sleeve 86 with the bolt catch 56 in the catch 57 of the rear bolt 65. The bolt assembly is compressing the spring or biasing member 66.

Figure 6:
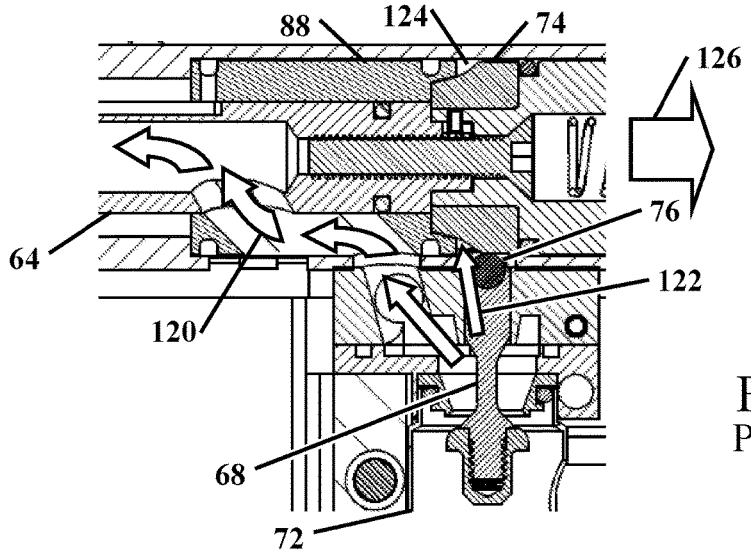
FIG. 6 Prior Art
FIG. 6 shows a sectional view of the launcher with air movement at launch.

In FIG. 4 the trigger is pulled and the bolt catch 56 is released from the catch 57. The compression of the spring 66 moves the bolt assembly forward. As the bolt assembly reaches the end of stroke, as shown in FIG. 5, the ramp 74 depressed the wear member 76 and opens the valve 68 to let the air in the space 72 escape in two directions. FIG. 6 shows a sectional view of the launcher with air movement at launch. The first direction 120 is out the front of the bolt to propel the projectile. The second direction 122 fills the gland area 124 between the separator and the ramp. The two directions of flow occur essentially simultaneously. After firing the ball, all the mass that fires the ball, all the gas that has been building-up in the gland area 124 blows the bolt assembly 50 back 126 to the position shown in FIG. 3. The O-ring seal the area that acts like a gland 124. During the drawback the pulse of air is shared.

While this is the prior art method, in the preferred embodiment, it is preferred to first have all of the air going to the back of the projectile only, without any air going to the gland chamber 124 until the projectile has been launched. After the projectile is launched the air should be redirected into the gland area 124, thereby not wasting any air that would blow into the gland area 124 at the same time air is being used to launch the projectile. The sharing of the air is inefficient and limits ball velocity at low air pressure.

The improvement changes the operation with a shuttle valve, but the valve may be referred to as a spool valve.

Figure 7:
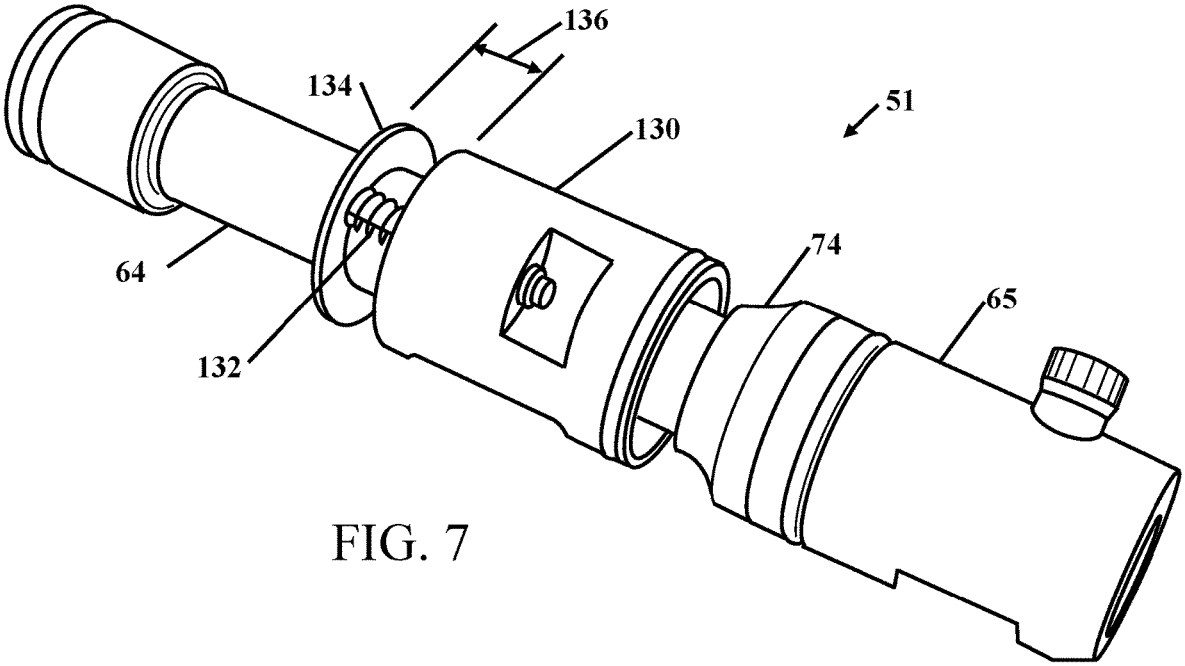
FIG. 7 shows a perspective view of the new bolt.

FIG. 7 shows the improvement in the shuttle system and the new bolt 51. The air is coining through into this back of this re-cocked chamber from a hole that is drilled on the other side of the front bolt to form a manifold and there is the vent for the back of the re-cock chamber. This is a bulkhead separator 130 the redirects air from the manifold up to the center of the bolt. This flange 134 rests on the shoulder and the purpose of the shoulder is at the right point, the bulkhead separator 130 is struck by the bolt, the bulkhead 130 is retained. In this figure, the springs 132 have a limited travel stroke and stop point that is controlled by the pin 137. In this embodiment, the O-rings are important for sealing the different areas of the launcher. There is a definite limited stroke and stop point. The springs 132 allows the bulkhead separator 130 to collapse a finite amount 136 then return to the stop by resting on pin 137. In the prior art the bulkhead is a fixed length and does not change the overall length. The sleeve is also different to control air movement into the gland area after the projectile has been launched.

Figure 8A:
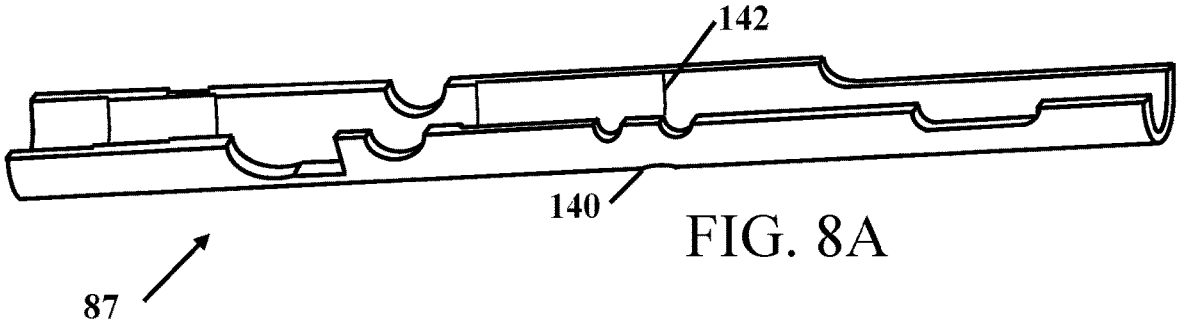
FIG. 8A shows a section of the new bolt sleeve.
Figure 8B:
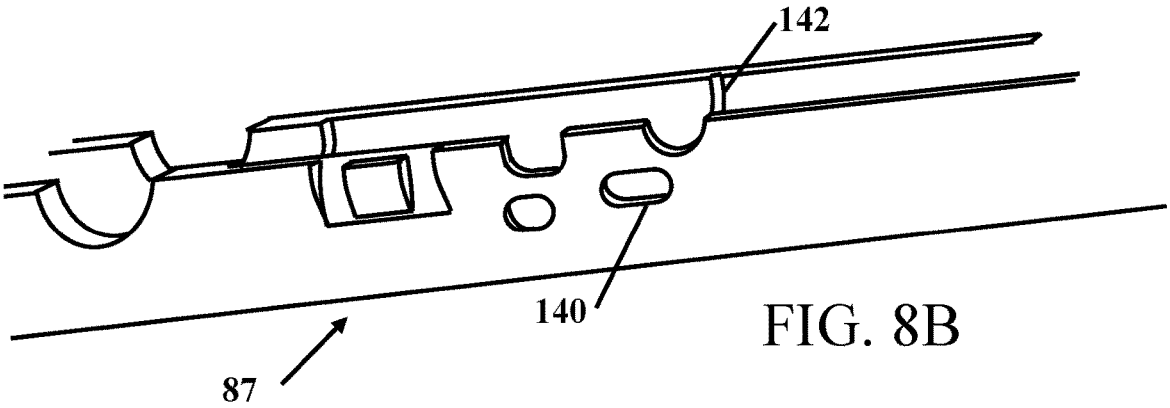
FIG. 8B shows a portion of the bolt sleeve.
Figure 8C:
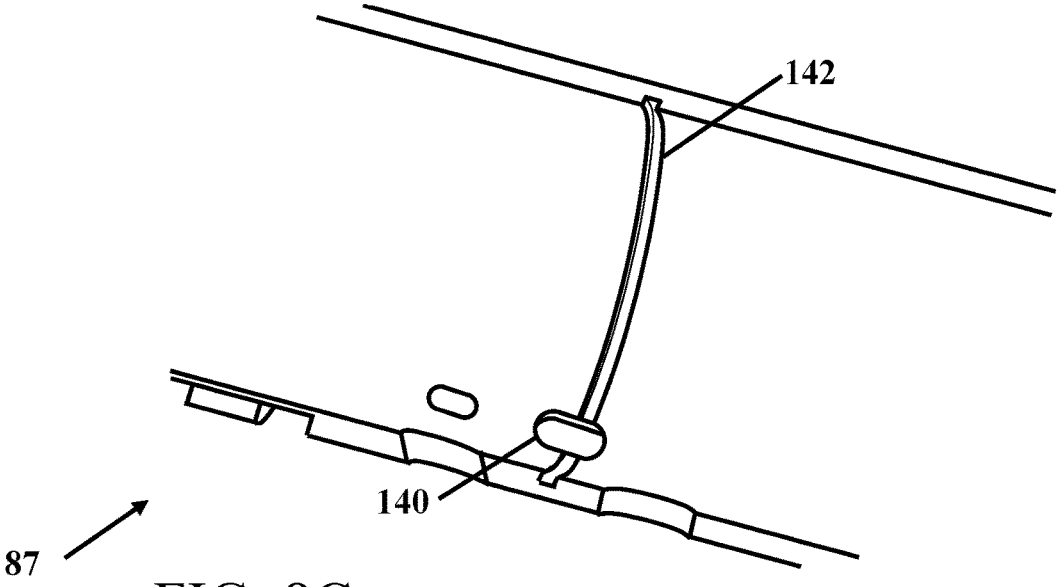
FIG. 8C shows the groove in the bolt sleeve.

FIG. 8A-8C show a cross-section of the new bolt sleeve 87. There is a port 140 whereby air coining from the airspace 72 in the valve 68 from the pulse of the valve 68 through port 140 and is redirected to a communication port means or an internal groove 142 that goes completely around the inside of the bolt sleeve. This allows air to move around the bolt sleeve to evenly distribute air around the bolt.

Figure 9:
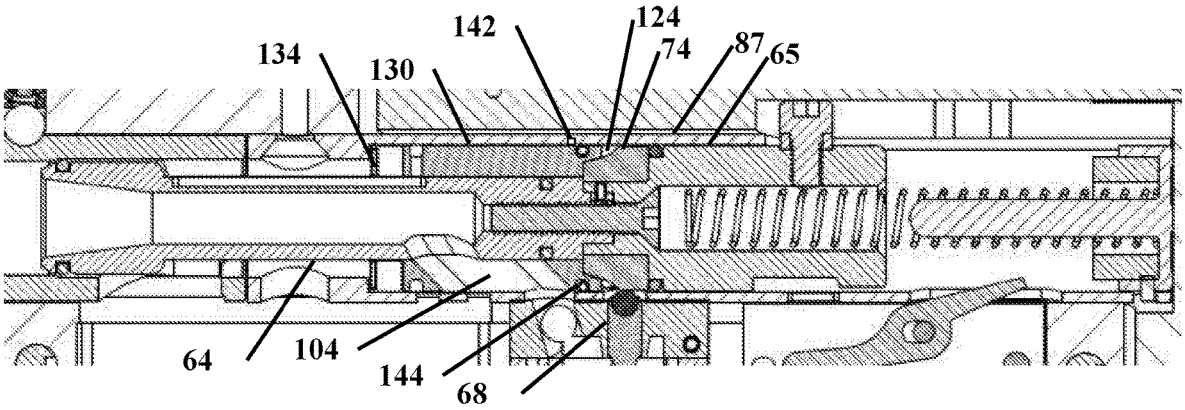
FIG. 9 shows a cross sectional view of the new bolt as the projectile is being launched.

FIG. 9 shows a cross sectional view of the new bolt as the projectile is being launched. In the sequence of operation when the trigger 12 is pulled, the ramp 74 comes into contact and strikes the bulk head separator 130. The valve 68 is opened to allow air to flow into the aperture 104 and out of the front bolt 64 to launch the projectile. The valve 68 is completely opened and the air can only flow out the aperture 104, into the front bolt 64 and towards the projectile. Air is blocked from filling the gland area 124. In the continued process, the forward momentum continues to drive the rear bolt 65 forward. As the rear bolt and ramp 74 moves forward an O-ring 144 seals off the port 104.

Figure 10:
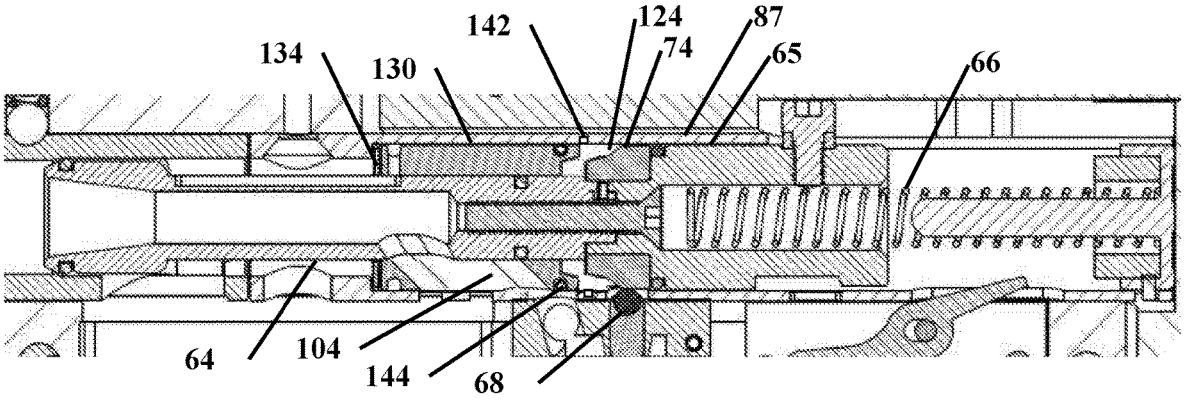
FIG. 10 shows a cross sectional view of the new bolt ready to reset.

FIG. 10 shows a cross sectional view of the new bolt ready to reset. The momentum moves the bulkhead separator 130 over the grove 142 and passes the bulkhead separator 130 over that gland 124, the gasses can only enter the gland 124 because the gasses are sealed by O-rings 144. The gassed then fill-up the gland 124. The mass of the bulkhead separator 130 is forced forward, and orifice aperture 104 that is firing the projectile closes and shuts the port off. As the bulkhead separator 130 moves to a forward stop the orifice aperture is completely shut off, and all of the gasses are re-directed to the gland area 124 to push the bolt assembly 51 rearward.

The bolt assembly is pushed to compress the biasing spring 65 to the reset position closing up the valve 68. This works in the full-auto mode, because of the two cycles, wherein the first cycle all of the air is going and firing the ball and none of the air is going into the re-cock chamber, then as the bulkhead separator 130 continues to go forward, it closes off all of the air that would want to escape freely throughout this chamber and the passage and goes to launch the projectile. In this embodiment, air is no longer wasted and is instead re-directed to the re-cock chamber to blowing the bolt back and then resetting the bolt of the launcher to prepare the launcher to fire another projectile.

Figure 11A:
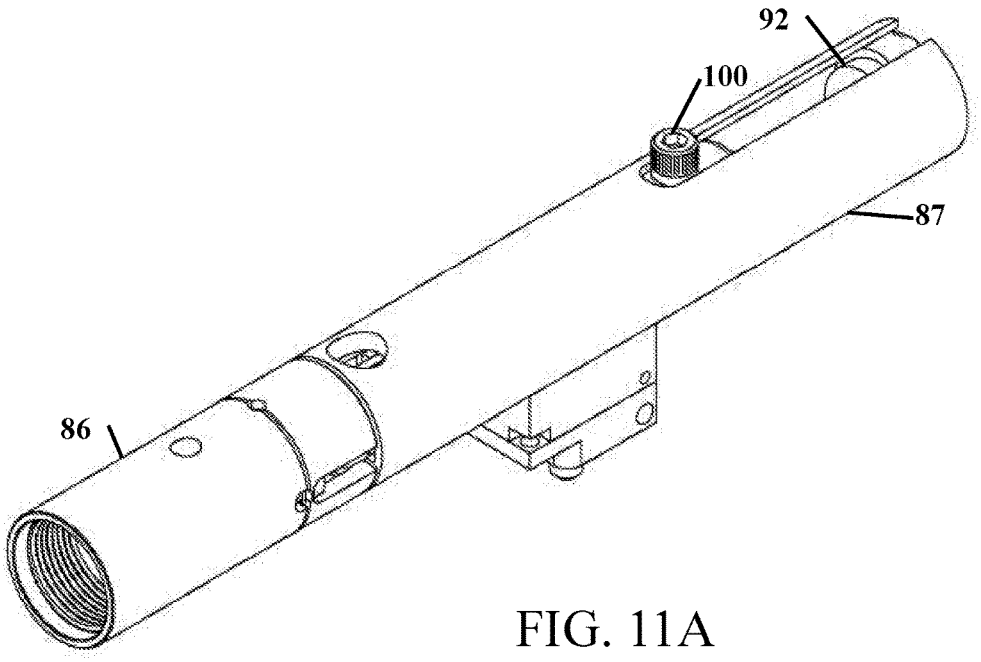
FIG. 11A shows the outer tube assembly of the flow directing closed bolt flow-back system.
Figure 11B:
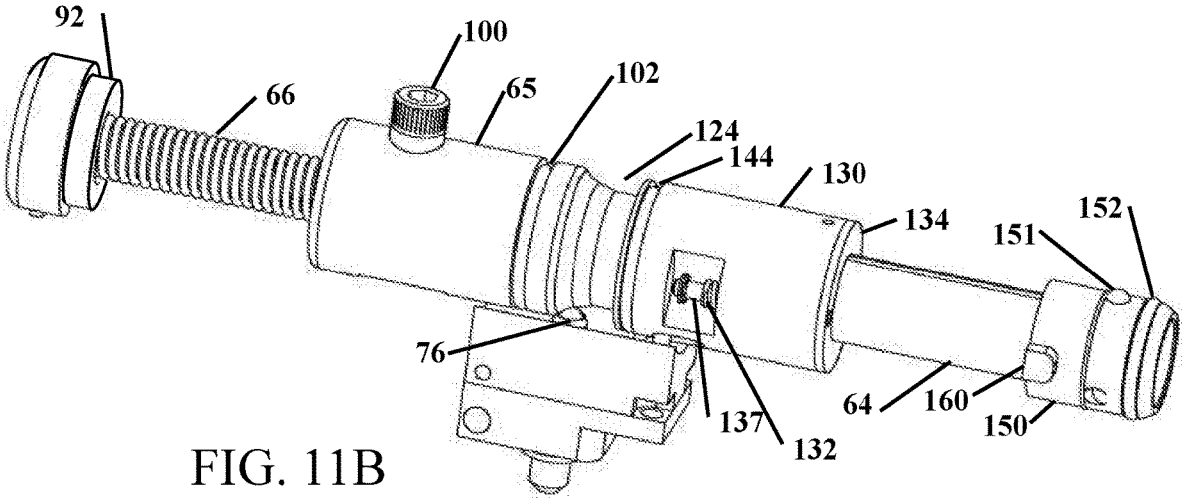
FIG. 11B shows the flow directing closed bolt flow-back system with the bolt sleeve and the rear bolt sleeve removed.

FIG. 11A shows the outer tube assembly of the flow directing closed bolt flow-back system. And FIG. 11B shows the flow directing closed bolt flow-back system with the bolt sleeve and the rear bolt sleeve removed. A pin 137 is shown in FIG. 11B. The pin 137 is press-fit to be flush with the bottom surface of the manifold. The pin 137 acts as the forward stop to the bulkhead separator 130. The bulkhead separator 130 can then move back-and-fourth. It can then move against the washer and the bulkhead separator 130 is limited from going forward by the pin 137 that stop or limits movement. The description and interaction of these components is shown and described in FIGS. 12A-12D.

Figure 12A:
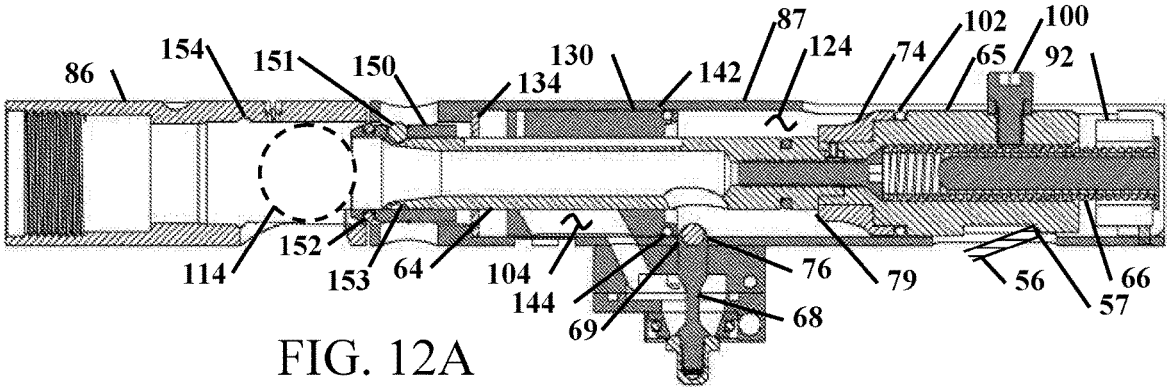
FIG. 12A-12D show the flow directing closed bolt flow-back system in the different stages of firing.

FIG. 12A-12D show the flow directing closed bolt flow-back system in the different stages of firing. These figures show a high-performance bolt system that will fit into the platform of the previously described projectile launching system. This is a flow directing closed bolt flow-back system. This utilizes the ball retention system with the new detent system. FIG. 12A shows a system that is similar to a blow-back system but has several differences. In FIG. 12A the rear bolt 65 is retracted in the bolt sleeve 87, where the rear bolt 65 is held in place by the bolt catch 56. The bolt catch 56 prevents the compression spring 66 from pushing the rear bolt 65 forward.

Figure 13:
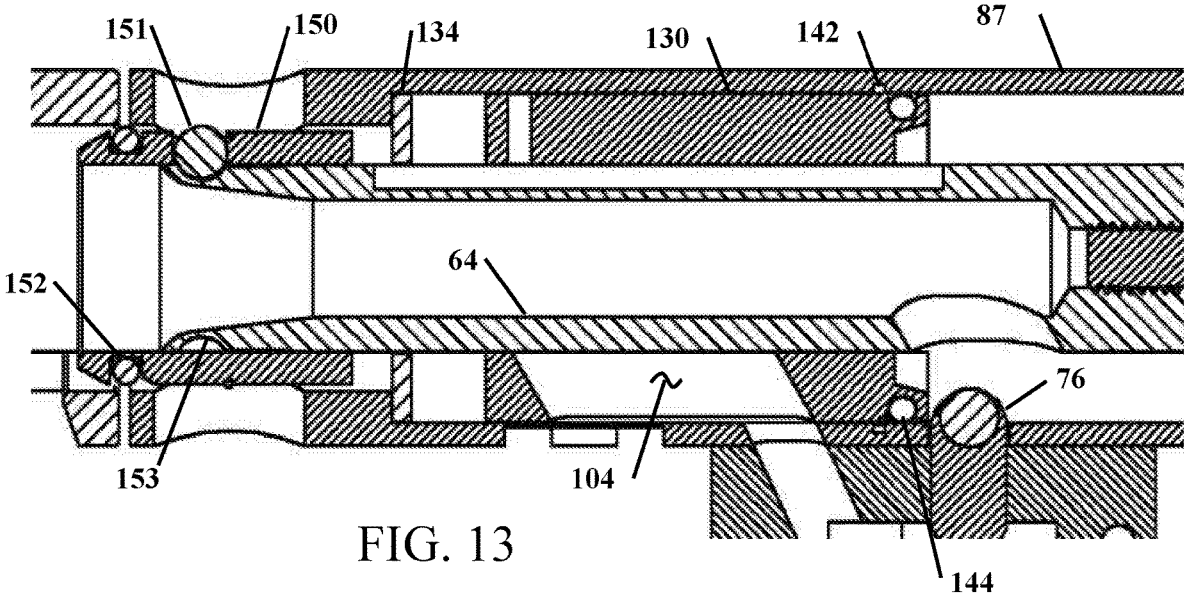
FIG. 13 is an enlarged area of the breach.

This embodiment makes to two operates independent from each other, propelling a projectile 114 from the breach area and re-cocking the rear bolt 65 and the connected components. FIG. 13 is an enlarged area of the breach. In this figure the bolt sleeve 87 is different.

Where the re-cock port 69 is going up as normal to the bolt sleeve 86, what is different is that we channel that, not directly to the bolt sleeve 86 in through here, but by a communication port means, hole or groove 142. On the outside of the bolt sleeve 87 is a communication port means, air channel or inner groove 142 as shown in FIG. 8C. This embodiment also includes a spring-loaded bulkhead separator 130 that is allowed to float as shown in FIG. 7.

When the bulkhead separator 130 moves from the rear bolt 65, where the striker 79 contacts the bulkhead separator 130, the rear bolt 65 pushes the bulkhead separator 130. This is the transition from FIG. 11A to 11B. An O-ring 144 isolates the area where the air is going to direct air flow only into the aperture 104. The moment this gets struck all of the air is going through the rear bolt 64 when the catch releases the rear bolt 65.

The air is being directed to the back of the ball or projectile 114, and no air is going into the re-cock gland area 124. Momentum will continue to carry the rear bolt 65 and the bulkhead separator 130 forward, and it will start pushing the bulkhead separator 130 and turns the bulkhead separator 130 and turn it into an actual valve. Note that in FIG. 12B the wear element 76 of the valve 68 has just made contact with the ramp area 74 of the striker 79.

Figure 12B:
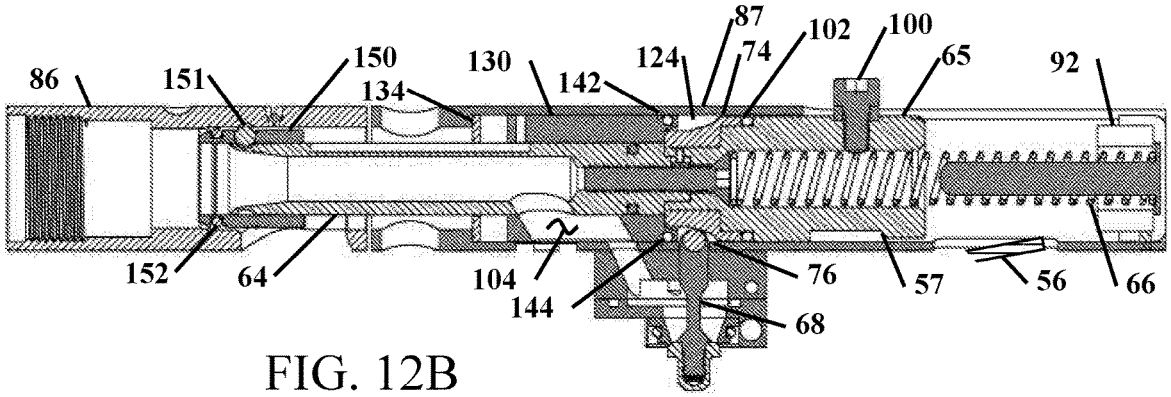
Figure 12C:
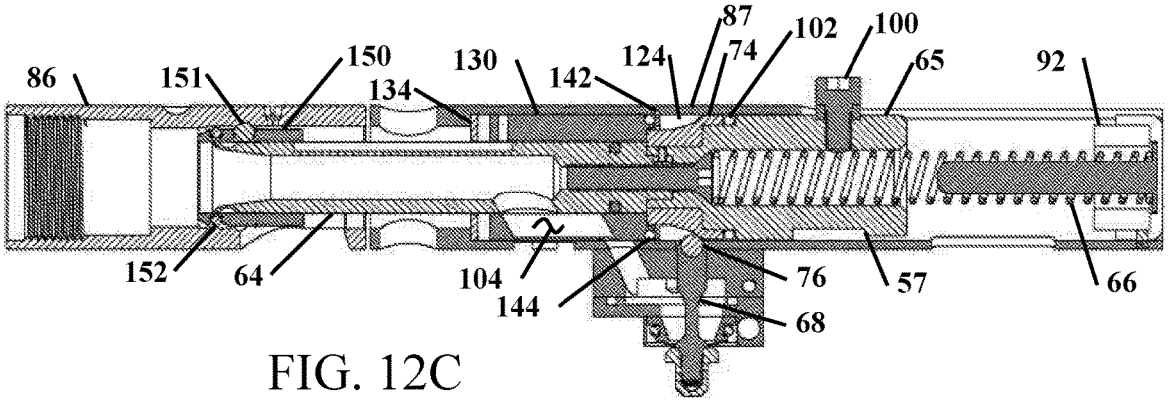

The outside surface area of the front bolt 64, or the greater portion of the surface area locks itself into position as the ball 151 engages into annular groove 153 as shown in FIG. 12B as the front bolt and the sliding bolt 150 continue forward the ball 151 comes up and locks itself into this groove 164. The engagement of the ball 151 into groove 154, it pushes this bulkhead seal O-ring 144 over the other side of this groove 142. This is shown in the transition from FIG. 12B to 12C. Now the air is starting to be vented into the recock gland area 124. The air fills the recock gland area 124 and makes the bulkhead separator 130 completely move even farther forward as in the transition from FIG. 13C to FIG. 12D. The air in the recock gland area 124 shuts-off any air in the aperture 80 to the pathway to the aperture 104.

Figure 12D:
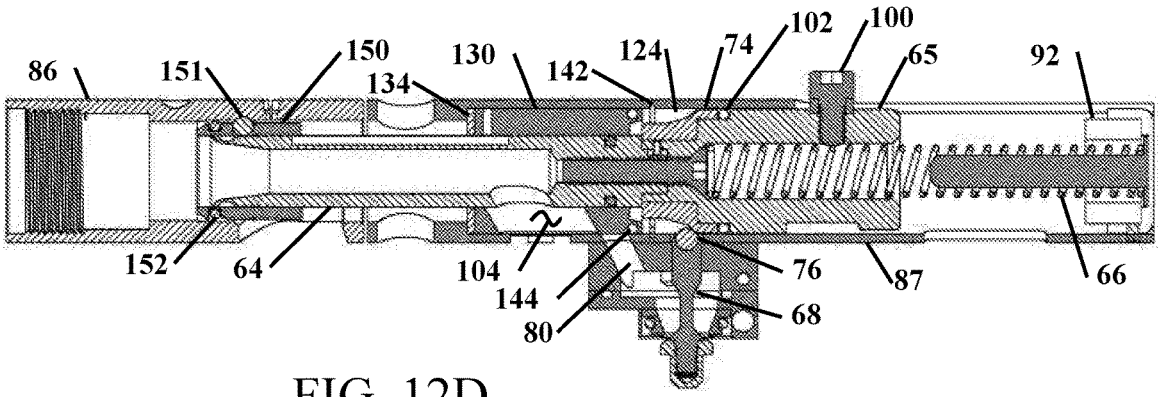

At the position shown in FIG. 12D all of the air is going into the recock chamber gland area 124 only. The bulkhead separator 130 acts like a slide valve. After the bulkhead separator 130 re-cocks the rear bolt 65 and the connected components where they slide into position as shown in FIG. 12A where bolt catch 56 holds the rear bolt 65 again and the pneumatic launcher is ready to re-fire.

Figure 14A:
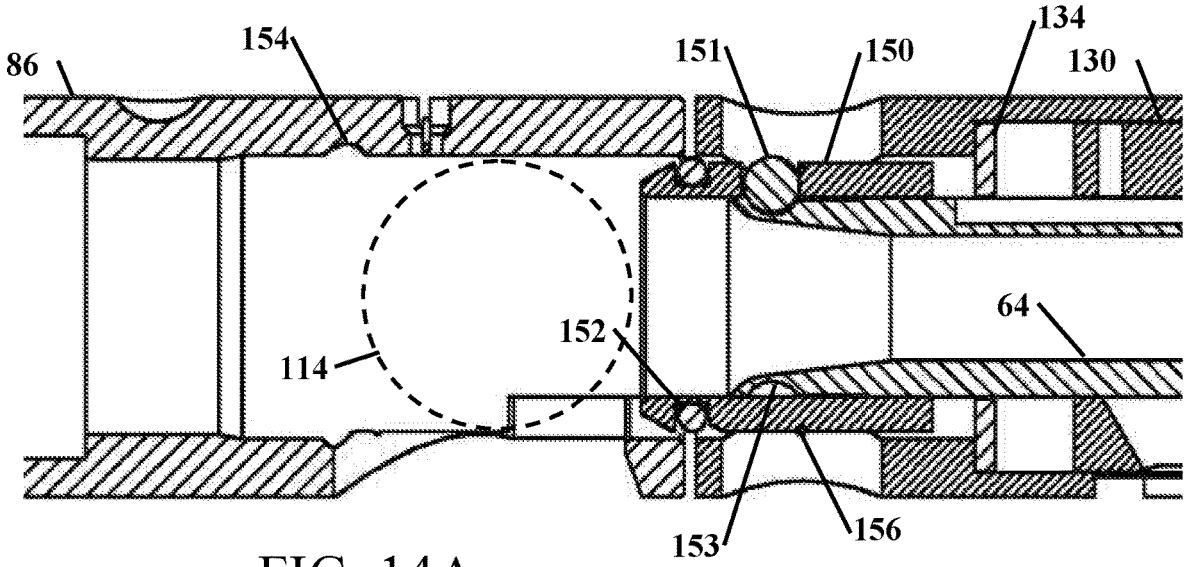
FIGS. 14A and 14B show detailed views of the sliding bolt on the front bolt.
Figure 14B:
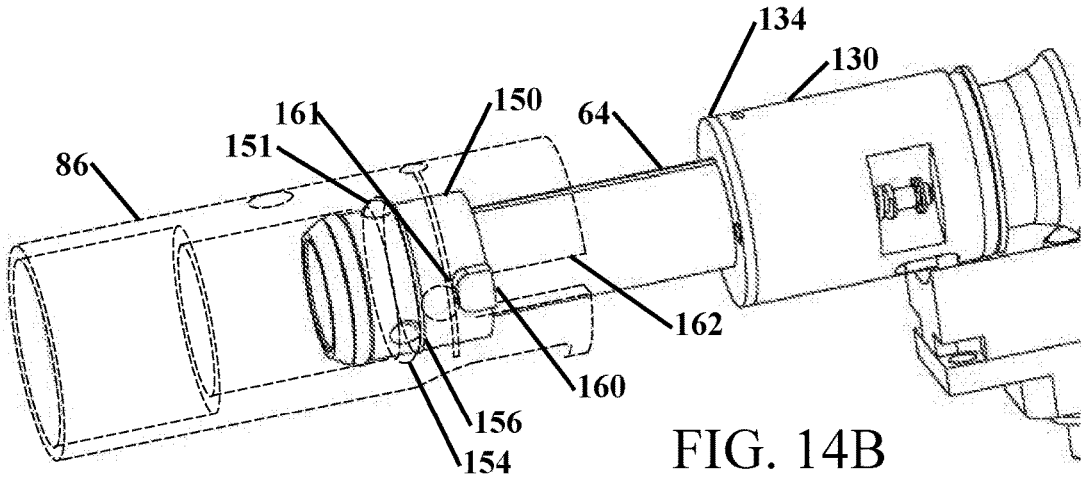

FIGS. 14A and 14B show detailed views of the sliding bolt on the front bolt. In these figures, the annular groove 153 on the inside of the front bolt 64 is shown. The annular groove 153 is conformal to at least one or more balls 151 (only one ball is shown). While balls are shows it can also be a rod(s) or roller bearing(s). The ball(s) is/are retained with a wire keeper 156 or clip that keeps the ball(s) rod(s) or bearing(s) 151 from falling out. As the front bolt 64 goes forward a lug this lug 160 on the front bolt 64 hits the end 161 of the slot 162 to create a stop point, and the outer portion of the lug 160 hits the end 161 portion of the front bolt 64 and the front bolt 64 is prevented from moving forward. Because the front bolt 64 is stopped on the outside portion of the bolt, the sliding bolt 150 continues to move forward. As the sliding bolt 150 continues to move forward, the sliding bolt 150 continues to push the ball(s) 151 up into the groove 153, locking it. Because the pressure of the ball(s) 151 can't act on the large outside diameter surface area of the groove 154 (see the position of the ball 151 in groove 154 from FIG. 12C) of the surface area.

The difference between this inside diameter of the front bolt 64 is about 0.50 inch in diameter compared to the diameter of the projectile 114 that is about 0.69. The difference in diameters as about double the surface area. As the pressure builds behind the projectile 114, the pressure has no influence on the inner diameter of front bolt 64. It only has influence on the inner diameter of the bolt sleeve 86.

In FIGS. 14A and 14B the grooves 153 are shown with the ball(s) 151 recessed in the front bolt 64. When the front bolt 64 moves forward the ball(s) 151 have clearance to retract within the groove 153 or recess area. When the front bolt 64 moves forward the lugs 160 on the sliding bolt 150 stop forward movement of the sliding bolt 150 locks. The front bolt 64 continues to move forward, locking these three balls 151 into place. The front bolt 64 can continue to move forward and it can even go all of the way up to flush, depending upon momentum. The rear bolt 65, front bolt and the sliding bolt 150 become a complete looking bolt.

Thus, specific embodiments of a pneumatic launcher system and method has been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A two-stage air gun fire and reset comprising:

a bolt assembly having a moving bulkhead separator;

said moving bulkhead separator is connected to a flange with at least one restrained spring that limits travel of said moving bulkhead separator;

said bolt assembly is configured to fit within a bolt sleeve;

said bolt sleeve having a communication port;

said flange on said moving bulkhead separator is configured to have a first position that directs air flow of a pneumatic launcher to launch a projectile and a second position that re-cocks said bolt assembly.

2. The two-stage air gun fire and reset according to claim 1 wherein said bolt assembly further includes a ramp that actuates a valve to supply airflow.

3. The two-stage air gun fire and reset according to claim 1 wherein said moving bulkhead separator further includes at least one O-ring.

4. The two-stage air gun fire and reset according to claim 1 that does not utilize blowback from a firing sequence.

5. The two-stage air gun fire and reset according to claim 1 wherein gas that re-cocks said bolt assembly does not exit said bolt assembly.

6. The two-stage air gun fire and reset according to claim 1 wherein air passing around said bolt sleeve within said communication port is evenly distributed around said bolt assembly.

7. The two-stage air gun fire and reset according to claim 1 wherein when a trigger is pulled, a ramp on said bolt assembly makes contact with said bulkhead separator.

8. The two-stage air gun fire and reset according to claim 7 wherein when said ramp contacts said bulkhead separator a valve is opened and air flows into an aperture and out of a front bolt to launch a projectile and provides forward momentum to a rear bolt forward.

9. The two-stage air gun fire and reset according to claim 8 wherein movement of said rear bolt seals off a port.

10. The two-stage air gun fire and reset according to claim 9 wherein when said port is sealed air can only enter a gland area.

11. The two-stage air gun fire and reset according to claim 10 wherein air entering said gland area pushes said bolt assembly rearward.

12. The two-stage air gun fire and reset according to claim 2 further includes a biasing spring.

13. The two-stage air gun fire and reset according to claim 12 wherein said at least one restrained spring is a biasing spring that closes said valve.

14. The two-stage air gun fire and reset according to claim 1 wherein said communication port creates a moving port or a moving gate.

15. The two-stage air gun fire and reset according to claim 8 wherein a cross-sectional area of a projectile is about ½ of a cross-sectional area of said front bolt.

16. The two-stage air gun fire and reset according to claim 15 wherein a pressure behind said projectile has no effect on an inner diameter of said front bolt.

17. The two-stage air gun fire and reset according to claim 6 wherein said communication port is an internal circular groove.

18. The two-stage air gun fire and reset according to claim 8 wherein said front bolt is supported on at least one ball.

19. The two-stage air gun fire and reset according to claim 8 wherein said front bolt is supported on at least one rod.

20. The two-stage air gun fire and reset according to claim 10 wherein an O-ring seals said gland area.

* * * * *